US006807736B2

(12) United States Patent
Langley

(10) Patent No.: US 6,807,736 B2
(45) Date of Patent: Oct. 26, 2004

(54) COLOR-CODED ATTACHMENT COMB KEY FOR HAIR CLIPPER

(75) Inventor: Luther Langley, Sterling, IL (US)

(73) Assignee: Wahl Clipper Corporation, Sterling, IL (US)

( * ) Notice: Subject to any disclaimer, the term of this patent is extended or adjusted under 35 U.S.C. 154(b) by 16 days.

(21) Appl. No.: 09/962,725

(22) Filed: Sep. 25, 2001

(65) Prior Publication Data

US 2003/0056374 A1 Mar. 27, 2003

(51) Int. Cl.[7] ..... B26B 19/38
(52) U.S. Cl. ..... 30/123
(58) Field of Search ..... 30/1, 200, 233, 30/233.5, 123; 81/121.1, 180.1

(56) References Cited

U.S. PATENT DOCUMENTS

| | | | | |
|---|---|---|---|---|
| 1,387,261 A | | 8/1921 | Harmuth | |
| 1,525,754 A | | 2/1925 | LePage | |
| 3,969,819 A | | 7/1976 | Pepera | |
| 4,193,615 A | | 3/1980 | Memmott | |
| 4,533,328 A | | 8/1985 | McDaniel | |
| 4,982,627 A | * | 1/1991 | Johnson | 81/121.1 |
| 5,031,488 A | * | 7/1991 | Zumeta | 81/180.1 |
| 5,573,529 A | | 11/1996 | Haak et al. | |
| 5,824,384 A | | 10/1998 | Hickox | |

FOREIGN PATENT DOCUMENTS

GB 2288727 A 1/1995

OTHER PUBLICATIONS

Wahl 19 Piece Color Coded Hair Cutting System Model No. WAH 79300–500 released in May 1999, see "Finding A Home At Gourmet" from HFN The Weekly Newspaper for the Home Furnishing Network dated May 2, 1999.*

Product and package for Wahl Model 79300–500 (photographs of the package, product, and inlay card are submitted), 1999 Wahl Clipper Corporation.

N. Owen et al., Littlewoods Extra, LAI site main thumbnail page, Sep. 4, 2001, retrieved from Internet: <URL: http://www.littlewoodsextra.com/extra/rf.inf.SessionServlet-?pathinfo=extra/browse/ProductPage.html&pca=60908151&rootcat_id=59373011&category_id=59372989&version_id=304.

Wahl UK, Consumer Page, retrieved from Internet: <URL:http://www.wahl.co.uk>.

Colour code for resistors and capacitors, of common general knowledge of longstanding, retrieved from Internet: <URL:http://www.ctech.ac.za/facul/eng/ee/human/pcb-home/Colour.html/>.

* cited by examiner

*Primary Examiner*—Hwei-Siu Payer
(74) *Attorney, Agent, or Firm*—Greer, Burns & Crain, Ltd.

(57) ABSTRACT

An apparatus for associating a size of an attachment comb for a hair cutting device with a color on or of the attachment comb representing that particular size. The apparatus includes a chart having a plurality of symbols that pictorially represents both the attachment comb sizes of a plurality of attachment combs, and the colors related to the respective attachment comb sizes. The symbols have a magnitude along one direction that is greater or smaller than other symbols on the chart depending on their respective attachment comb sizes, to produce a visual association between a cutting device size and a cutting device color.

17 Claims, 4 Drawing Sheets

COLOR-CODED ATTACHMENT COMB KEY FOR HAIR CLIPPER

BACKGROUND OF THE INVENTION

The present invention relates generally to hair cutting devices having cutting guides, also known as attachment combs. More particularly, the present invention relates to a color-coded attachment comb key, which visually associates a number of colors with a number of sizes of attachment combs that are coded according to size.

Hair cutting devices may be supplied with several adjustable or non-adjustable, removable attachment combs, which assist a user in cutting hair to a uniform length. When an attachment comb is used, it is typically attached to an end of the hair cutting device, near the device's cutting blades. By virtue of its design, the attachment comb maintains the cutting blades at a set and predetermined distance from the skin or scalp surface where hair is being cut. This enables the user to trim a subject's hair to a uniform and predetermined length.

A single attachment comb is typically sized to cut hair to a single predetermined length. If a different length is desired, the user must change the attachment comb to one having a different size. Since desired hair length can vary widely with the particular user or hairstyle, a purchaser of a hair cutting device often purchases a number of differently sized attachment combs. Multiple attachment combs of varying sizes are often sold in a set, though the attachment combs may be also be purchased individually.

In some sets of differently sized attachment combs, each attachment comb is made of the same material (often plastic), and has the same color. Though the size of each attachment comb is usually marked on the attachment comb's body in some manner, a user wanting to choose a particularly sized attachment comb from among a set of differently sized attachment combs typically has to search through the set, reading the size marked on the body of each attachment comb, until the desired size is found.

To address this problem, sets of attachment combs have been introduced having color codes, with particular colors representing particular sizes. The color is physically connected to a particular attachment comb by, for example, impregnating the attachment comb plastic with the particular color, or by attaching a sticker or label containing the color to an attachment comb. By using such a color code, it becomes easier for a user to select an attachment comb having a desired size without having to examine the individual attachment combs for size markings.

However, the present inventor has discovered problems with the existing devices and methods for associating an attachment comb size with a particular color. Often, attachment combs are selected in haste based upon a quick glance at a written description. If a user misreads the (often small) numerals contained on these descriptions, an incorrect attachment comb is selected. Also, if the user is unsure which specific numerical size is needed, or is not skilled with fractions or the measuring system used, selecting a desired attachment comb can be difficult, and may require undesirable trial and error. This is overly burdensome, especially if a user is individually purchasing the attachment combs. Associating a particular attachment comb color from among a large number of colors with a particular size, and thus choosing a desired size, can therefore be overly frustrating and time-consuming.

An object of the present invention is to provide an improved color-coded attachment comb key that allows a user to quickly and easily associate a particular color with a particular attachment comb size.

Another object of the present invention is to provide a hair cutting system that allows a user to easily select a desired size of attachment comb for a hair cutting device, while minimizing selection error.

Another object of the present invention is to provide an improved apparatus for enabling a user of a hair cutting device to readily identify and select a particularly sized attachment comb from a set of differently sized attachment combs, even if the user is unsure of the specific measurement needed.

SUMMARY OF THE INVENTION

The above-listed objects are met or exceeded by the apparatus of the present invention, which provides a color-coded attachment comb key that visually associates an attachment comb size and the attachment comb color related to the attachment comb size. The key is typically in the form of a chart, containing a plurality of symbols. Each of the plurality of symbols depicts both an attachment comb size and its related attachment comb color. The depiction of the attachment comb size is typically performed by configuring each symbol so as to have a magnitude along at least one dimension (such as length) that is greater or smaller than that of the other symbols representing smaller or larger attachment comb sizes, respectively. By containing a pictorial representation of both an attachment comb size and its related color, the improved attachment comb key mnemonically associates attachment comb sizes and colors, thus providing a simpler, quicker, and more reliable selection of proper attachment combs.

DESCRIPTION OF THE PREFERRED EMBODIMENT

Figure 1:
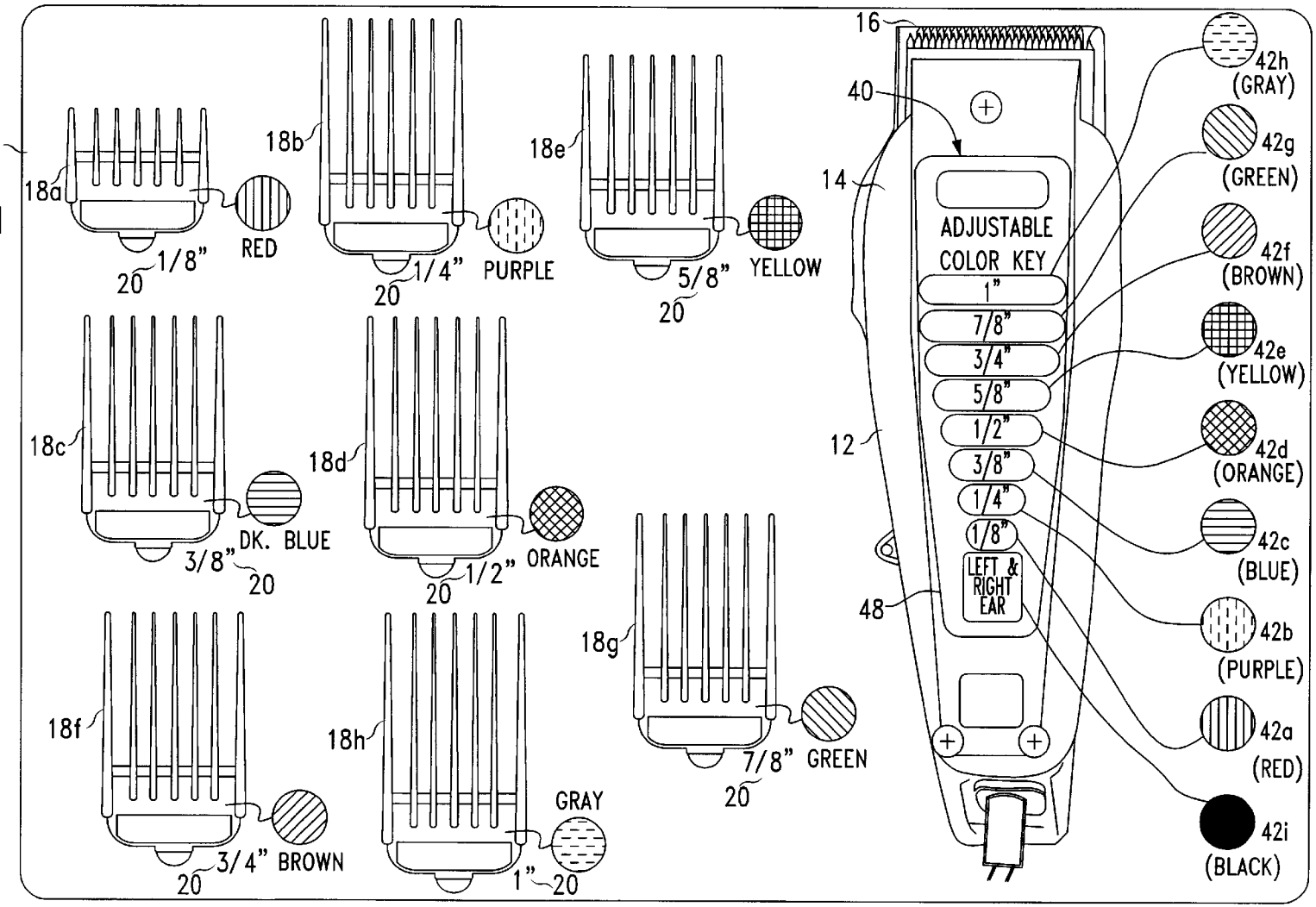
FIG. 1 is a diagrammatic view of one embodiment of the hair cutting system of the present invention.
Figure 6:
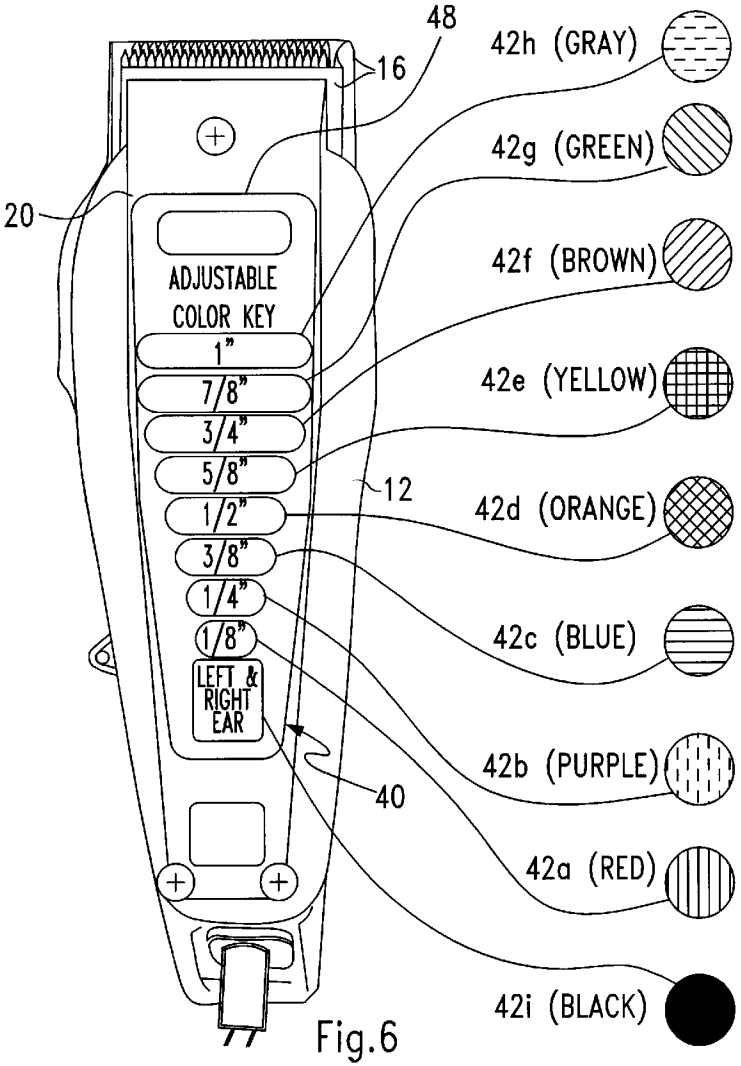
FIG. 6 is a plan view of a hair cutting device with an attachment comb key on its lid.

In FIG. 1, an embodiment of a hair cutting system having a color-coded attachment comb key according to the present invention is depicted and generally designated 10. The system 10 includes a hair cutting device 12 having a body 14, and cutting blades 16 positioned on an end of the body. The system 10 also includes a plurality of differently colored, differently sized attachment combs 18*a*, 18*b*, 18*c*, 18*d*, 18*e*, 18*f*, 18*g*, 18*h*, and a packaging insert 19, which may include a written description 20 (such as a numeral) indicating the attachment combs' respective sizes. The system also includes an attachment comb key 40 which, as seen in FIGS. 1 and 6, may be attached to the hair cutting device 12.

For purposes of the present invention, it is contemplated that any hair cutting device 12 may be used, so long as it is designed to accommodate removable attachment combs. The hair cutting device 12 is designed so that the attachment combs 18*a*–18*h* may be readily attached and detached. It is contemplated that the attachment combs 18*a*–18*h* can be attached to the hair cutting device 12 in any one of a variety of ways which are well known in the art. For example, the attachment combs 18*a*–18*h* may be attached to the body 14 or to the blades 16 of the hair cutting device 12.

Figure 2:
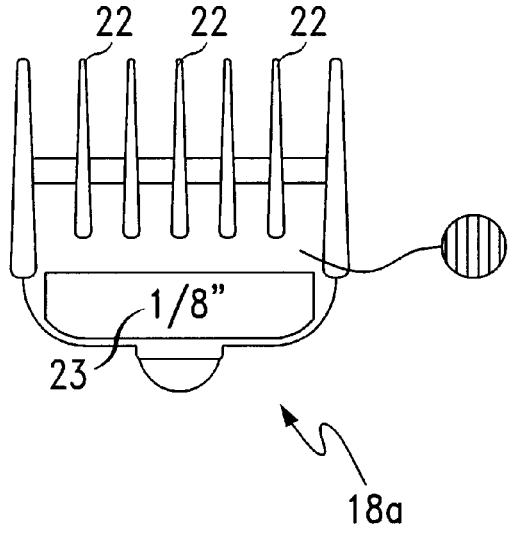
FIG. 2 is a top view of an attachment comb.
Figure 3:
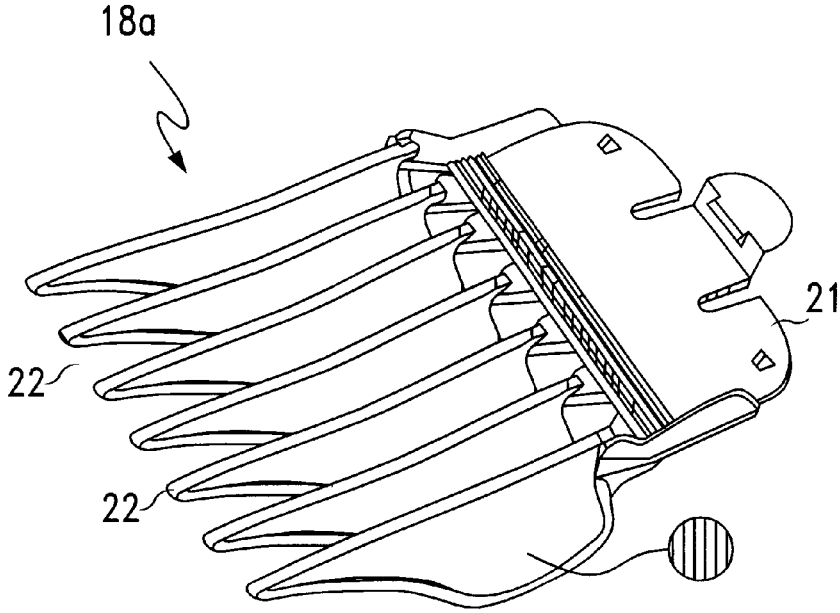
FIG. 3 is a perspective view of an attachment comb.

FIGS. 2 and 3 show a typical attachment comb 18*a*. The attachment comb 18*a* is designed to be removably attachable with the hair cutting device 12, and has a substantially planar surface 21 (best seen in FIG. 3) and multiple fins or blades 22. The fins 22 extend or project from the planar surface 21 of the attachment comb 18*a*. The attachment comb 18*a* will typically have a size (⅛" for example) 23 marked on its surface.

Figure 4:
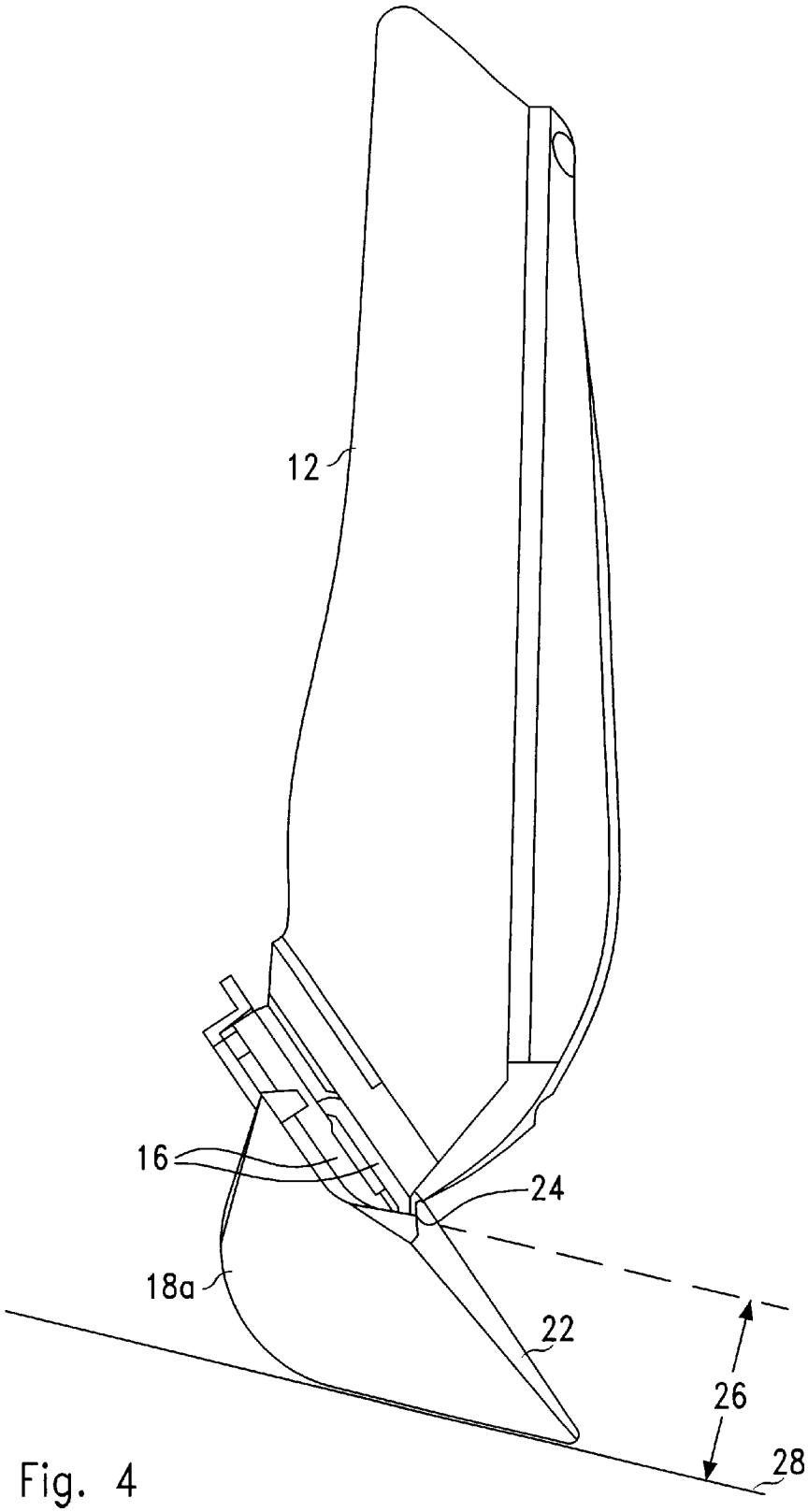
FIG. 4 is a side view of a hair cutting device with an attached attachment comb.

Referring now to FIG. 4, when the attachment comb 18*a*, for example, is mounted on the hair cutting device 12, the attachment comb functions to maintain a cutting surface 24 of the cutting blades 16 a uniform distance 26 from a surface 28 (such as the scalp or skin) where hair is being trimmed. The uniform distance 26 corresponds generally to the size 23 marked on the attachment comb.

A particularly sized attachment comb 18*a*, for example, may be used to assist the user of the hair cutting device 12 in cutting hair to a single uniform and predetermined length. If a different hair length is desired, the user must attach a differently sized attachment comb 18*b*, for example, to the hair cutting device 12. Desired hair length can vary widely with the particular user and hairstyle. For this reason, the hair cutting device 12 will typically have a number of differently sized attachment combs 18*a*–18*h* associated with it (FIG. 1), from among which particular attachment comb sizes may be selected as desired. While eight differently sized attachment combs 18*a*–18*h* are shown, it is contemplated that the hair cutting system 10 could be provided with any number of differently sized attachment combs.

Each differently sized attachment comb 18*a*–18*h* defines one of a plurality of predetermined distances 26 between the surface 28 from which hair is being trimmed and the cutting surface 24 of the cutting blades 16 attached to the hair cutting device 12. As indicated above, the present invention contemplates that any number of individual attachment combs, in any number of different sizes and colors, may form the set of attachment combs associated with the hair cutting device 12. As shown in FIGS. 1–3, the set of attachment combs includes at least one attachment comb 18*a*–18*h* in each of the following sizes, respectively: ⅛", ¼", ⅜", ½", ⅝", ¾", ⅞" and 1". Also, in this exemplar embodiment, the set of attachment combs includes at least one attachment comb in each of the following colors: red, purple, dark blue, orange, yellow, brown, green, and gray, respectively. In FIGS. 1–3, a name of a color and/or a shaded circle representing the color for each of the attachment combs 18*a*–18*h* is pictured to symbolically indicate the attachment comb's respective color. For example, the word "red" and a circle shaded to indicate the color red beside the attachment comb 18*a* is used in FIG. 1 to signify that the attachment comb 18*a* is colored entirely red. By coloring each of the attachment combs, a number of colors are related to respective attachment comb sizes. In another embodiment, the colors could relate to the sizes of their respective attachment combs in special ways, for example, darker or more intense colors for larger sizes. The color may be impregnated in the plastic, or differently colored stickers or labels may be attached to differently sized attachment combs. It is contemplated that the sizes and associated colors may vary to suit the application, and that those provided are merely for purposes of explanation.

Figure 5:
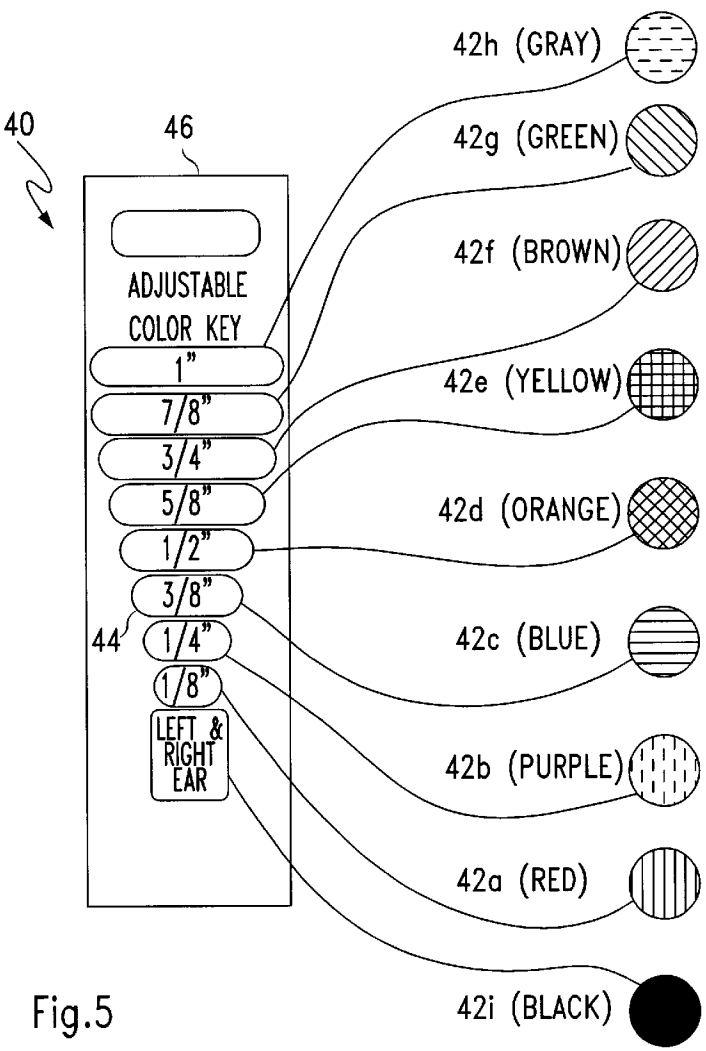
FIG. 5 is a diagrammatic view of one embodiment of an attachment comb key of the present invention.

Referring now to FIGS. 1, 5, and 6, the color-coded attachment comb key 40 is provided in the hair cutting system 10 for visually associating each one of the plurality of attachment comb sizes with each one of the plurality of attachment comb colors. By referring to the key 40, one using the present invention can, by looking at the color of a particular attachment comb, quickly and easily determine the particular size of the attachment comb, as well as its relative size compared to other guides/combs.

In the preferred embodiment, the key 40 is in the form of a chart that contains a plurality of symbols 42*a*–42*h*. These symbols may be any of various shapes, including lines, squares, rectangles, ovals, circles, etc., but preferably are shapes having a substantial longitudinal magnitude. Each of the plurality of symbols 42*a*–42*h* depicts, or visually represents, an attachment comb size and attachment comb color for attachment combs 18*a*–18*h*, respectively. Preferably, the size of each of the represented attachment combs is printed in the form of numerals 44 on or near the symbols. For example, in FIG. 5, symbol 42*c* has "⅜"" printed within. An additional symbol 42*i* that represents a special attachment comb, such as an ear taper or trimming comb could also be included on the key 40.

As described above, each attachment comb 18*a*–18*h* has a particular size and color. Thus, to mnemonically associate an attachment comb size with an attachment comb color, the symbol pictorially represents both the color and the size of a respective attachment comb. First, to depict color, each of the symbols 42*a*–42*h* displays its represented color, i.e., the color related to that symbol's respective attachment comb size. For example, the symbol may be composed nearly entirely of that color, as indicated on the key 40 shown in FIGS. 1, 5, and 6, or the color may only fill in a portion of the symbol or border the symbol. As shown in FIGS. 1 and 5–6, a name of a respective color and/or a circle having shading representing the color is displayed beside each of the symbols 42*a*–42*h*, to indicate that the symbol is composed entirely of that respective color, except for a border or numerical size marking, such as in symbol 42*c*. For example, in FIG. 6, the word "yellow" and a circle representing the color yellow are shown next to symbol 42*e* to indicate that the symbol 42*e* is colored yellow. The size and color information may be printed in the represented colors, if desired. In one contemplated embodiment, numerals 44 printed on each symbol may be in the represented color. In the key shown in FIG. 5, as indicated by the shadings of symbols 42*a*–42*h*, the oval-shaped symbols are, with the exception of the printed numerals 44 within the symbols, composed entirely of the color of their represented attachment comb sizes.

Second, to depict size, each of the symbols 42*a*–42*h* has a magnitude along at least one dimension that is either larger or smaller than the magnitude along that same dimension for the other symbols, depending upon the respective attachment comb sizes they represent. For example, in FIG. 5, symbol 42*f*, representing an attachment comb size ¾", is larger along its length than symbols 42*a*–42*e*, representing attachment comb sizes of ⅛", ¼", ⅜", ½", and ⅝", respectively, but is smaller along its length than symbols 42*g* and 42*h*, representing attachment comb sizes of ⅞" and 1", respectively. The symbol dimension used for pictorial representation of size may be length, width, height, or a combination. In this way, a user can quickly and easily associate a color with a size, by visually associating the respective symbol's color with its length, for example. Because the key 40 pictorially represents both size and color, it is an effective mnemonic device for associating the two, making it easier for the user to memorize the association.

Also, to further reinforce the association, the symbols 42*a*–42*h* may be arranged on a surface, such as paper 46, in ascending order or descending order of their length (or width, or height). This allows a user to quickly locate a particular attachment comb size, associate it with a symbol color, and select an attachment comb of that color. In a preferred embodiment, the lengths of the symbols are proportional to their respective attachment comb sizes. In a further preferred embodiment, the symbol lengths are equal to the attachment comb sizes. In the latter case, the key has an additional benefit of allowing a user to select a size and associate the size with a color, thereby selecting an attachment comb, without having to refer to the printed numerals at all. These preferred embodiments are especially helpful to a user who is not skilled in fractions or a particular measurement system, or who may have difficulty reading the (typically small) numerals 44 printed on the key.

The additional symbol 42*i*, or symbols, may be in a color different from that of symbols 42*a*–42*h*, and may be visually different in terms of size or shape, as well. For example, in FIG. 5, symbol 42*i* is depicted in black and is more rectangular than symbols 42*a*–42*h*. This further reinforces the uniqueness of that represented attachment comb to the user.

In operation, users of the key 40 can easily identify and select a particularly sized attachment comb from a set of differently sized attachment combs, without having to sort through the attachment combs and read the size of each. A user of the hair cutting system 10 employing this key 40 can determine the size of the attachment comb by selecting a desired attachment comb size, referring to the key 40 to identify the color of the selected attachment comb size, selecting the attachment comb having the color of the particular size, and attaching the selected attachment comb to the hair cutting device 12.

Because the key 40 pictorially represents the attachment combs in both color and size, and visually associates the two, the key mnemonically associates a color with a size, and thereby the user can more easily, quickly, and accurately select an attachment comb having a desired size. Mistakes are minimized, as even when a printed measurement is misread, a user has at least a relative, if not absolute, visualization of the attachment comb size the user is about to select and use. Over time, due to the improved visual association provided by the key 40, regular users of the present apparatus and method may no longer need to refer to the key 40 in order to recognize and identify a particularly sized attachment comb.

The key 40 may be printed on a variety of surfaces, such as a separate piece of paper 46 or cardboard. The paper 46 or cardboard can be placed inside the package holding the hair cutting system 10, or it can be included as part of the packaging insert 19. The packaging insert 19, shown in FIG. 1, is a piece of cardboard or paperboard with places for the various components in the system 10. The entire assembly is encased in plastic for point of purchase display and sale. The key 40 can also be on a label 48 placed on the hair cutting device 12, as shown in FIGS. 1 and 6. Of course, more than one key can be provided, if desired.

While a particular embodiment of the present color-coded attachment comb key for hair clipper has been shown and described, it will be appreciated by those skilled in the art that changes and modifications may be made thereto without departing from the invention in its broader aspects and as set forth in the following claims.

What is claimed is:

1. In a hair cutting system having a hair cutting device and a plurality of attachment combs configured to be removably attached to the hair cutting device, each of the plurality of attachment combs having one of a plurality of colors and one of a plurality of sizes relating to an approximate distance between a scalp and cutting blades of the cutting device, so that each of the attachment comb colors relates to an attachment comb size, an apparatus for visually associating each one of the attachment comb colors to each one of the attachment comb sizes, the apparatus comprising:

a chart having a plurality of symbols, each of said plurality of symbols pictorially representing both one of the plurality of attachment comb sizes and the attachment comb color associated with each said one of the plurality of attachment comb sizes;

wherein each of said plurality of symbols displays said attachment comb color associated with a corresponding one of the plurality of attachment comb sizes, and has a magnitude along at least one dimension that is both greater than a remainder of said plurality of symbols representing smaller attachment comb sizes and smaller than a remainder of said plurality of symbols representing larger attachment comb sizes.

2. The apparatus of claim 1 wherein said plurality of symbols is arranged in said chart in order of said represented attachment comb sizes.

3. The apparatus of claim 2 wherein said plurality of symbols is arranged from largest represented attachment comb size to smallest represented attachment comb size.

4. The apparatus of claim 2 wherein said plurality of symbols is arranged from smallest represented attachment comb size to largest represented attachment comb size.

5. The apparatus of claim 1 wherein each of said plurality of symbols has a magnitude along said at least one dimension that is proportional to said represented attachment comb size.

6. The apparatus of claim 1 wherein each of said plurality of symbols has a magnitude along said at least one dimension that is equal to said represented attachment comb size.

7. The apparatus of claim 1 wherein said chart is contained on a card.

8. The apparatus of claim 1 wherein said chart is visibly disposed on a label attached to said hair cutting device.

9. The apparatus of claim 1 wherein said at least one dimension is length.

10. The apparatus of claim 1 wherein each of said plurality of symbols is marked with numerals relating to the represented attachment comb sizes.

11. A hair cutting system for cutting hair to one of a plurality of predetermined lengths, the system comprising:

a hair cutting device;

a plurality of attachment combs configured to be removably attached to the hair cutting device, each of the plurality of attachment combs having one of a plurality of colors and one of a plurality of sizes relating to an approximate distance between a scalp and cutting blades of the cutting device, so that each of the attachment comb colors relates to an attachment comb size; and a color-coded attachment comb key for visually associating each one of the attachment comb colors to each one of the attachment comb sizes, the key having a plurality of symbols, each of said plurality of symbols pictorially representing one of the attachment comb sizes and the attachment comb color related to said one of the attachment comb sizes, each of said plurality of symbols displaying said attachment comb color representing said attachment comb size, and having a magnitude along at least one dimension greater than the remainder of said plurality of symbols representing smaller attachment comb sizes, and smaller than said remainder of said plurality of symbols representing larger attachment comb sizes;

wherein said key is visibly disposed on a label attached to said cutting device.

12. The system of claim 11 wherein said plurality of symbols is arranged in said key in order of said represented attachment comb sizes.

13. The system of claim 11 wherein each of said plurality of symbols has a magnitude along said at least one dimension that is proportional to said represented attachment comb size.

14. The system of claim 11 wherein each of said plurality of symbols has a magnitude along said at least one dimension that is equal to said represented attachment comb size.

15. The system of claim 11 wherein said at least one dimension is length.

16. The system of claim 11, wherein each of said plurality of symbols is marked with numerals relating to said represented attachment comb sizes.

17. A hair cutting system for cutting hair to one of a plurality of predetermined lengths, the system comprising:

a hair cutting device;

a plurality of attachment combs configured to be removably attached to the hair cutting device, each of the plurality of attachment combs having one of a plurality of colors and one of a plurality of sizes, so that each of the attachment comb colors relates to an attachment comb size; and a color-coded attachment comb key for visually associating each one of the attachment comb colors to each one of the attachment comb sizes, the key having a plurality of symbols, each of said plurality of symbols displaying said attachment comb color representing said attachment comb size, and having a magnitude along at least one dimension greater than a remainder of said plurality of symbols representing smaller attachment comb sizes, and smaller than a remainder of said plurality of symbols representing larger attachment comb sizes, wherein said plurality of symbols having a range of dimensional magnitudes provides a visual association between a color and an attachment comb size independent of numerals or letters;

wherein said key is visually disposed on a label attached to said cutting device.

* * * * *

UNITED STATES PATENT AND TRADEMARK OFFICE
Certificate

Patent No. 6,807,736 B2 Patented: October 26, 2004

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Gregory S. Wahl, Sterling, Illinois (US); and Patrick Anello, Sterling, Illinois (US).

Signed and Sealed this Eighteenth Day of July 2006.

ALLAN N. SHOAP
*Supervisory Patent Examiner*
Art Unit 3724

UNITED STATES PATENT AND TRADEMARK OFFICE

CERTIFICATE OF CORRECTION

PATENT NO. : 6,807,736 B2
APPLICATION NO. : 09/962725
DATED : October 26, 2004
INVENTOR(S) : Gregory S. Wahl and Patrick Anello It is certified that error appears in the above-identified patent and that said Letters Patent is hereby corrected as shown below:

In the Issued Patent:

In the Abstract, line 8, after "along one" please delete "direction," and insert --dimension-- therefor.

Column 1, line 50, after "present" please delete "inventor has," and insert --inventors have-- therefor.

Signed and Sealed this

Fourteenth Day of November, 2006

JON W. DUDAS
*Director of the United States Patent and Trademark Office*